US009890932B2

(12) United States Patent
Czech et al.

(10) Patent No.: US 9,890,932 B2
(45) Date of Patent: Feb. 13, 2018

(54) LUMINAIRE

(71) Applicant: Focal Point, LLC, Chicago, IL (US)

(72) Inventors: Ken Czech, Chicago, IL (US); Casey Chung, Chicago, IL (US); Jeremy Taylor, Chicago, IL (US); Scott Dupre, Chicago, IL (US); Scott Beu, Chicago, IL (US); Ronaldo Santiago, Chicago, IL (US)

(73) Assignee: Focal Point, LLC, Chicago, IL (US)

( * ) Notice: Subject to any disclaimer, the term of this patent is extended or adjusted under 35 U.S.C. 154(b) by 256 days.

(21) Appl. No.: 14/706,713

(22) Filed: May 7, 2015

(65) Prior Publication Data

US 2016/0327250 A1 Nov. 10, 2016

(51) Int. Cl.

| | |
|---|---|
| ***F21V 17/02*** | (2006.01) |
| ***F21V 7/00*** | (2006.01) |
| ***F21V 14/02*** | (2006.01) |
| ***F21V 14/04*** | (2006.01) |
| *F21S 8/02* | (2006.01) |
| *F21S 8/00* | (2006.01) |
| *F21V 15/01* | (2006.01) |
| *F21S 4/28* | (2016.01) |
| *F21Y 103/10* | (2016.01) |

(52) U.S. Cl.

CPC ..... *F21V 17/02* (2013.01); *F21V 7/005* (2013.01); *F21V 14/02* (2013.01); *F21V 14/04* (2013.01); *F21S 4/28* (2016.01); *F21S 8/022* (2013.01); *F21S 8/033* (2013.01); *F21V 15/013* (2013.01); *F21Y 2103/10* (2016.08)

(58) Field of Classification Search

CPC ... F21S 4/28; F21S 8/022; F21S 8/033; F21V 7/005; F21V 14/02; F21V 14/04; F21V 15/013; F21V 17/02; F21Y 2103/10

See application file for complete search history.

(56) References Cited

U.S. PATENT DOCUMENTS 7,648,261 B2 * 1/2010 Ko ..... F21L 14/02 362/269

* cited by examiner

*Primary Examiner* — Stephen F Husar

(74) *Attorney, Agent, or Firm* — Banner & Witcoff, Ltd.

(57) ABSTRACT

A luminaire configured for perimeter lighting, and having improved features for adjusting one or more lighting characteristics of said luminaire. In one example, the luminaire comprises a light bar structure that may be rotated relative to a housing structure of the luminaire. Additionally, the luminaire may have a light scoop structure for redirecting a portion of light emitted from the light bar structure. Further, an angle of the light scoop structure may be adjusted relative to the housing structure of the luminaire, and independently of the light bar structure.

18 Claims, 17 Drawing Sheets

LUMINAIRE

FIELD OF THE INVENTION

The present invention relates to the field of luminaires, and in particular, luminaires utilized for perimeter lighting.

BACKGROUND

A luminaire may be utilized to provide perimeter lighting. In one example, a luminaire configured for perimeter lighting may be positioned within a recess, or a cove structure. As such, one or more recesses, or cove structures, may be positioned around a perimeter of a space into which a luminaire is configured to provide lighting. In one example, recesses, or cove structures, may be configured with a variety of different dimensions (lengths, widths and/or heights). As such, a luminaire configured for recessed lighting may include features configured to adjust one or more lighting parameters (directionality, and the like) of the luminaire. Accordingly, the present disclosure provides for improved systems and methods for adjusting one or more lighting parameters associated with a luminaire configured for perimeter lighting.

BRIEF SUMMARY

The following presents a simplified summary of the present disclosure in order to provide a basic understanding of some aspects of the claimed subject matter. This summary is not an extensive overview of the claimed subject matter. It is not intended to identify key or critical elements of the claimed subject matter or to delineate the scope of the claimed subject matter. The following summary merely presents some concepts of the claimed subject matter in a simplified form as a prelude to a more detailed description provided below.

In one aspect, this disclosure describes a luminaire configured for perimeter lighting, and having improved features for adjusting one or more lighting characteristics of said luminaire. The luminaire may comprise a light bar structure positioned between a pair of bracket structures within a housing structure, and the light bar structure may rotate relative to the housing structure. The luminaire may also have a reflector structure that redirects a portion of light emitted from the light bar structure. The reflector structure may have a light scoop and a spine or pivot structure about which the reflector structure may rotate relative to the housing structure. The luminaire may further allow for an angle of rotation of the light bar structure to be adjustable independently of an angle rotation of the reflector structure.

In another aspect, a luminaire is described as having a housing structure that is positioned within a recessed cove. The housing structure may have a light bar structure for emitting visible light, and a hinge or pivot structure on the light bar structure that allows the light bar structure to rotate relative to the housing structure. The luminaire also has a reflector structure for redirection of light emitted from the light bar structure. Additionally, the reflector structure has a light scoop and a hinge or pivot structure, configured to rotate relative to the housing structure, and independently of the light bar structure. In yet another aspect, this disclosure includes a luminaire having a housing structure. The housing structure of the luminaire has a linear light source array and a light scoop, and each of the linear light source array and the light scoop are configured to rotate independently, relative to the housing structure.

BRIEF DESCRIPTION OF THE DRAWINGS

The present invention is illustrated by way of example and not limited in the accompanying figures in which like reference numerals indicate similar elements and in which.

DETAILED DESCRIPTION OF THE INVENTION

As discussed above, there is need for improved luminaire designs. Furthermore, as is apparent from the Figures described above and the description provided below, various components are disclosed below, wherein said components may be mounted to other components. Mounting may be direct or indirect and this disclosure is not intended to be limiting in this respect. It is noted that various components are described below as separate components. Two or more of these components may be combined to form a single component as appropriate, and this disclosure is not intended to be limiting in this respect.

In addition, various features are described below in greater detail. It should be noted that different combinations of these features may be combined as desired to generate luminaires with more or less features, depending on the features that are needed. Thus, it is envisioned that additional luminaires using combinations of the below described features are within the scope of the present invention.

Figure 1:
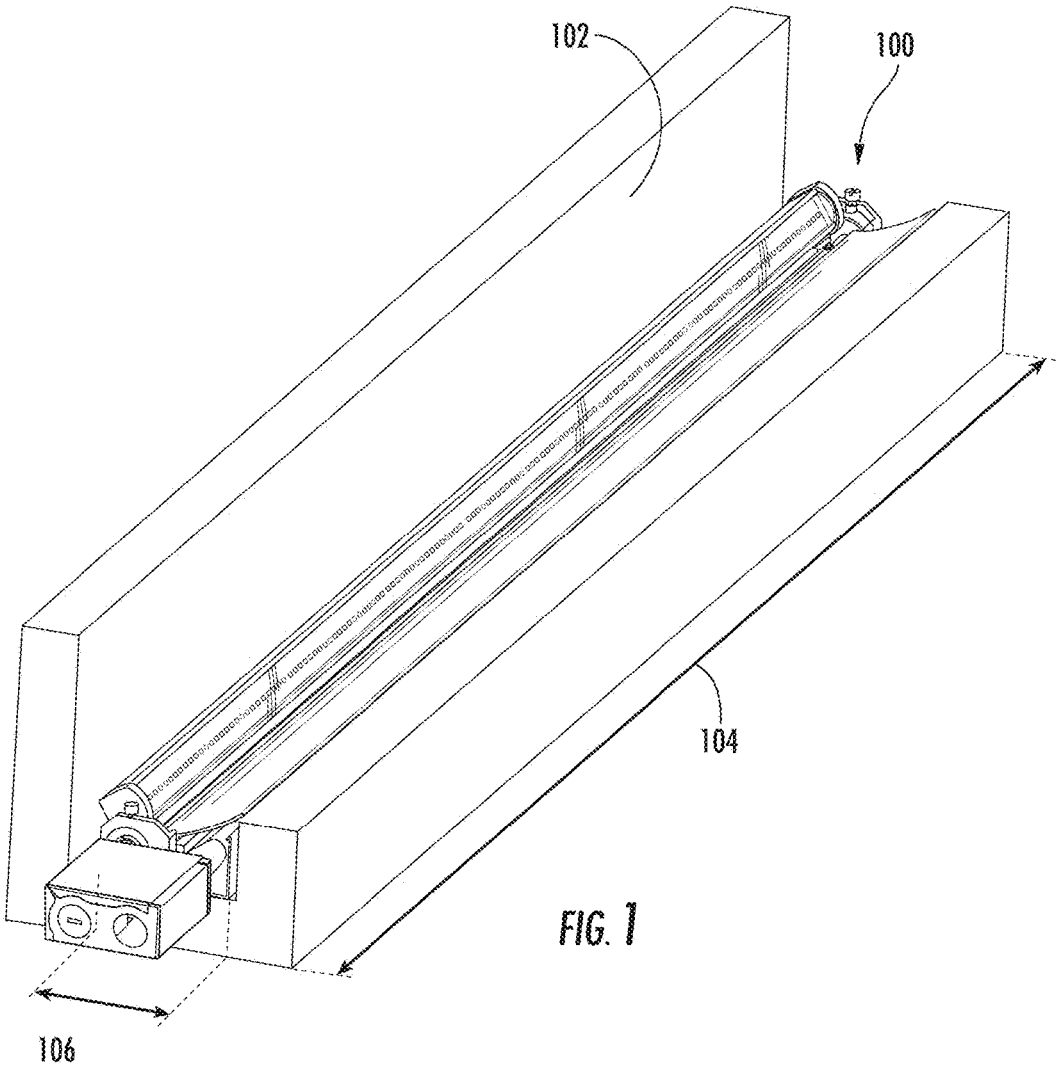
FIG. 1 illustrates one embodiment of a luminaire according to one or more aspects described herein.

In one implementation, the systems and methods described herein are directed towards one or more embodiments of a luminaire having improved features for adjusting one or more lighting characteristics of said luminaire. Accordingly, FIG. 1 schematically depicts a luminaire 100 positioned within a recessed cove structure 102. In one example, luminaire 100 comprises a substantially elongated structure within a substantially elongated cove structure 102.

As such, luminaire 100 extends along a longitudinal length 104, such that longitudinal length 104 is comparatively greater in length than width 106. However, those of ordinary skill in the art will recognize that luminaire 100 may be configured as a luminaire for perimeter lighting (a luminaire configured to be positioned within a recessed cove) such that luminaire 100 may have a longitudinal length 104 and a width 106 configured with any dimensions. Additionally, those of ordinary skill in the art will recognize that multiple luminaires, such as luminaire 100, may be positioned (spaced apart, or coupled to one another) within a recessed cove structure 102.

Figure 2:
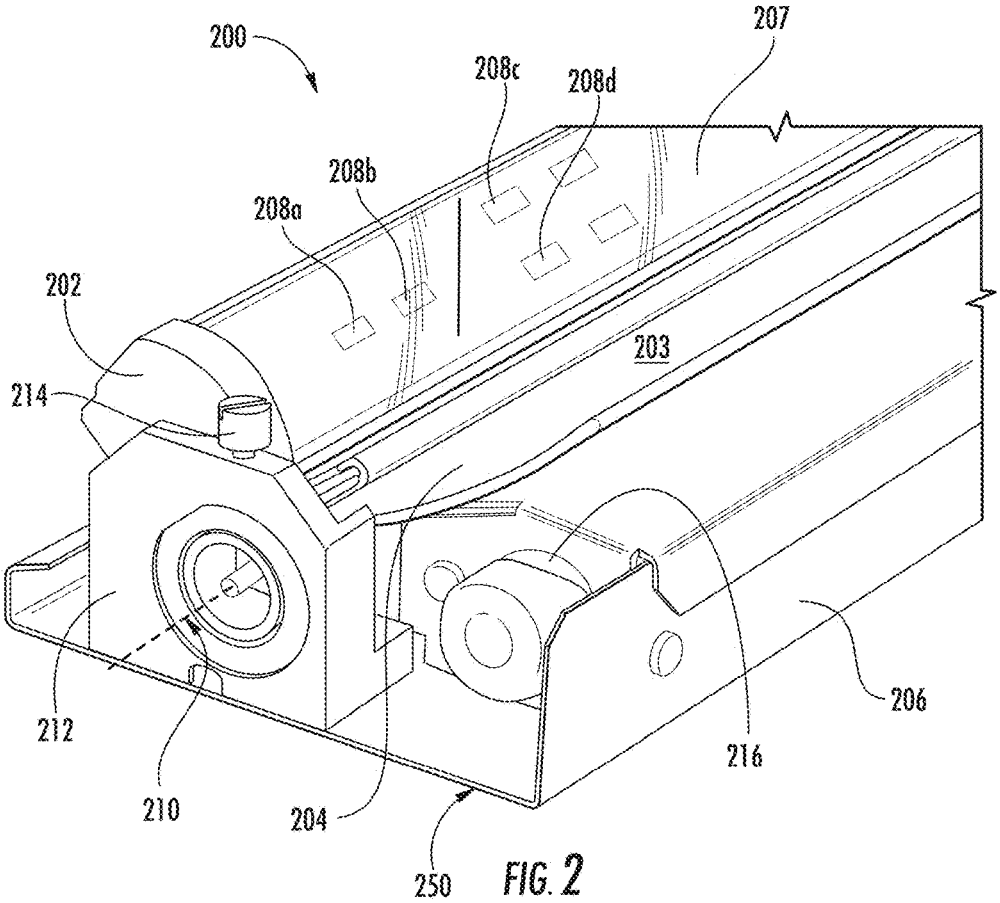
FIG. 2 illustrates an alternative view of an embodiment of a luminaire according to one or more aspects described herein.

FIG. 2 depicts a detailed view of luminaire 100 from FIG. 1. In one example, luminaire 100 comprises a light source array 202, a light scoop structure 204, a housing structure 206, a lock mechanism 212, and an electrical supply 216. In one example, light source array 202 comprises a plurality of light sources, wherein elements 208*a* and 208*b* are exemplary light sources from the plurality of light sources. In one example, light sources 208*a* and 208*b* are configured as a linear array (one-dimensional) substantially along a longitudinal length (such as longitudinal length 104) of luminaire 100. In another example, light source array 202 comprises a two-dimensional array of light sources, such as light sources 208*a* and 208*b*. In one example, light sources 208*a* and 208*b* are light-emitting diodes. In another implementation, luminaire 100 may be configured with element 202 having additional or alternative light source technologies. For example, luminaire 100 may comprise one or more fluorescent tube light sources, or incandescent light sources, among others. Furthermore, light source array 202 may comprise a single/continuous light-emitting element (such as, for example, a light-emitting diode) instead of discrete light sources (208*a*, 208*b*, among others).

In one example, light source array 202 comprises a structure that includes electrical circuitry (wiring, electrical components, and the like) configured to deliver electrical energy to the array of light sources (elements 208*a*, 208*b* and the like). Additionally, light source array 202 may comprise a structure having one or more heatsink elements configured to dissipate heat generated from one or more of light sources 208*a* and 208*b*, and the like. In one example, light source array 202 comprises a lens structure 207, wherein said lens 207 may comprise a transparent, partially-transparent, or translucent structure configured to shield one or more internal components of the light source array 202. In one implementation, said lens 207 may be configured to focus, diffuse, or transmit substantially unchanged, a portion of light energy (luminous flux) emitted from one or more light source elements 208*a* and 208*b*.

In one example, light scoop structure 204 may be configured to redirect a portion of light emitted from the light source array structure 202. Accordingly, the light scoop structure 204 may comprise a substantially reflective surface. In one example, light scoop structure 204 is configured to rotate about an axis of rotation 210. Accordingly, in one implementation, light source array structure 202 is configured to rotate independently of light scoop structure 204 such that a directionality (or a lighting "envelope," or area of illumination) of light emitted from light source array 202 may be adjusted.

In one implementation, light scoop structure 204 comprises a substantially concave structure facing towards light source array 202. Accordingly, surface 203 may be a substantially concave surface of light scoop structure 204, and may comprise, in one example, a reflective material configured to reflect a portion of light emitted from light source array 202.

In one example, luminaire 100 comprises a lock mechanism 212 comprising a structure configured to selectively prevent rotation of one or more of light scoop structure 204 and/or light source array structure 202 relative to housing structure 206. As such, lock mechanism 212 may be rigidly coupled to housing structure 206, and rotatably coupled to one or more of light scoop structure 204 and/or light source array structure 202. In order to selectively prevent rotation of one or more of light scoop structure 204 and/or light source array structure 202, thumb screw 214 may be actuated to rigidly couple light scoop structure 204 and/or light source array structure 202 to lock mechanism 212. This selective rigid coupling is described in further detail in relation to FIG. 4. In an alternative implementation, thumb screw 214 may be replaced by another component that serves as an adjustable linear actuator element. For example, thumb screw 214 may alternatively comprise a screw, a pin, a bolt, a clip, or an electrically-actuated linear actuator member, among others.

In one implementation, luminaire 100 comprises an electrical supply 216, wherein electrical supply 216 represents one or more components configured to supply electrical energy to the one or more light sources (e.g. 208*a* and 208*b*) that make up the light source array 202. In this way, electrical supply 216 may comprise one or more components (transformers, and the like) configured to step-up or step-down a voltage supplied to luminaire 100 from an external electrical energy supply (not pictured). Additionally, electrical supply 216 may comprise one or more components configured to condition a supply of electrical energy to luminaire 100 (A.C. to D.C. conversion, current limiting and the like). Furthermore, electrical supply 216 may comprise one or more components configured to dissipate heat generated within luminaire 100. In yet another implementation, electrical supply 216 may comprise wiring configured to allow a pair of luminaires, such as a pair of luminaire 100 to be positioned end-to-end such that end 250 of luminaire 100 may be positioned in contact with the corresponding end (not pictured) of another luminaire. In this way, two or more luminaires 100 may be positioned along a longitudinal length 104 of a recessed cove structure 102. Additionally, those of ordinary skill in the art will recognize various additional or alternative components that may be utilized within electrical supply 216 to provide electrical energy to light source array 202.

Those of ordinary skill in the art will recognize that luminaire 100 may be utilized with any power rating/lighting intensity rating/luminous flux of light sources, such as light sources 208*a* and 208*b*, and without departing from the disclosures described herein.

Those of ordinary skill in the art will recognize various structural materials that may be utilized in luminaire 100, wherein selection of a material may be based upon one or more of a specific properties, or structural properties including, among others, electrical conductivity, thermal conductivity, and mechanical strength. As such, one or more components of luminaire 100 may comprise, among others, a metal, an alloy, a ceramic, a polymer, a fiber-reinforced material, a wooden material, or combinations thereof. In one specific example, housing structure 206 comprises a sheet metal structure, and the like. In one specific example, light scoop 204 may comprise a metallized polymer configured to reflect light.

Figure 3:
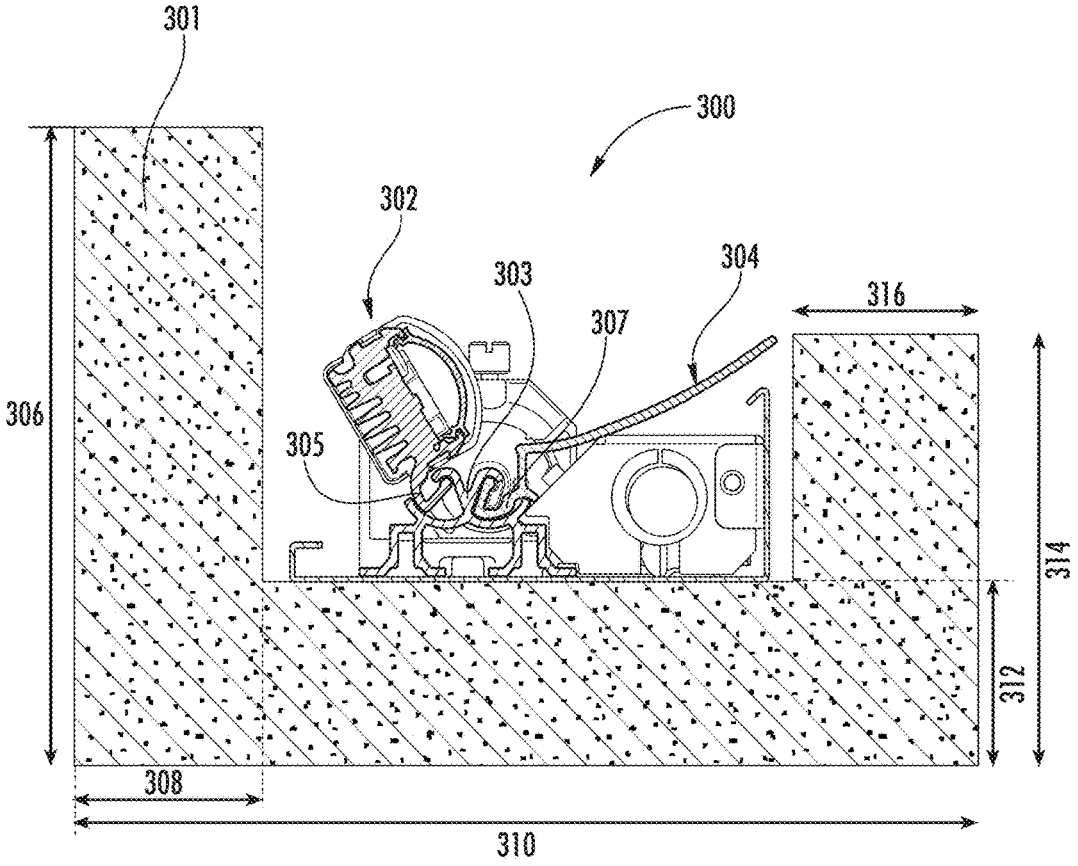
FIG. 3 illustrates a cross-sectional view of an exemplary embodiment of a luminaire according to one or more aspects described herein.

FIG. 3 depicts a cross-sectional view of luminaire 100. In particular, luminaire 100 is depicted as positioned within a recessed cove structure 301. Accordingly, in one example, recessed cove structure 301 is depicted as having lengths 306, 308, 310, 312, 314, and 316. Those of ordinary skill in the art will recognize, however, that these lengths 306-316 may each have any dimensional value, without departing from the scope of the disclosures described herein.

In particular, luminaire 100 is depicted as having a light source array structure 202 and a light scoop structure 204 in respective first orientations. As depicted, the light source array structure 202 is hingedly-coupled to the bracket structure 303 by a first hinge arm 305. Similarly, the light scoop structure 204 is hingedly-coupled to the bracket structure 303 by a second hinge arm 307. In one example, bracket structure 303 comprises a symmetrical cross-sectional area, and is configured to receive the first hinge arm 305 and the second hinge arm 307 to form a first nested circular hinge and a second nested circular hinge, respectively. Accordingly, the nested circular hinges are described in greater detail in relation to FIG. 6 and FIG. 7.

Figure 4A:
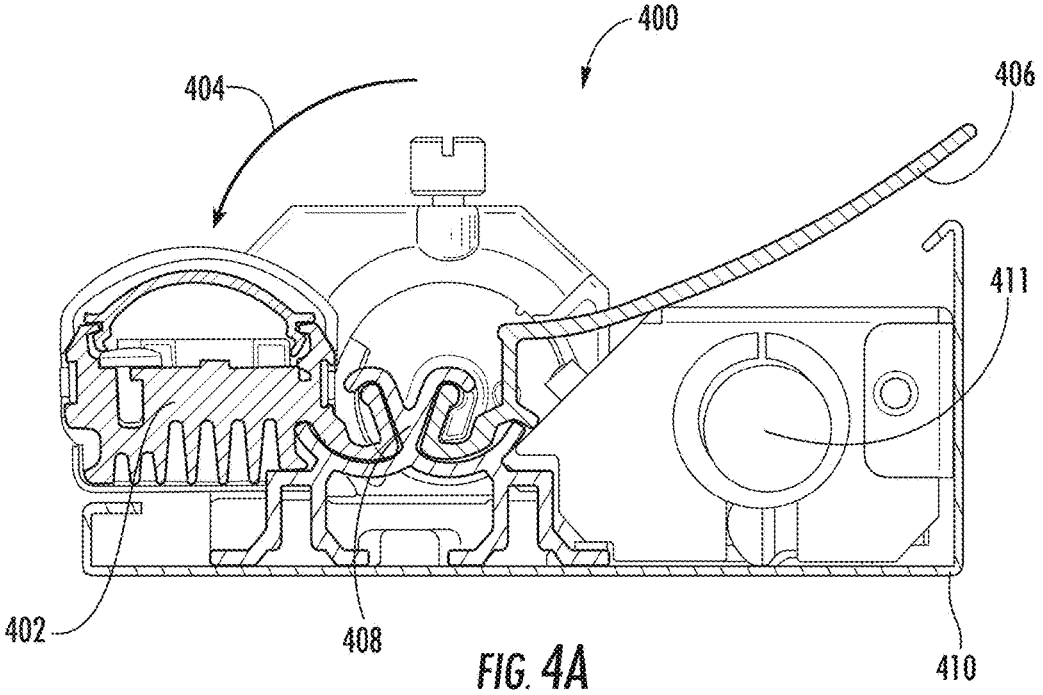
FIGS. 4A-4B depict further cross-sectional views of exemplary embodiments of a luminaire according to one or more aspects described herein.
Figure 4B:
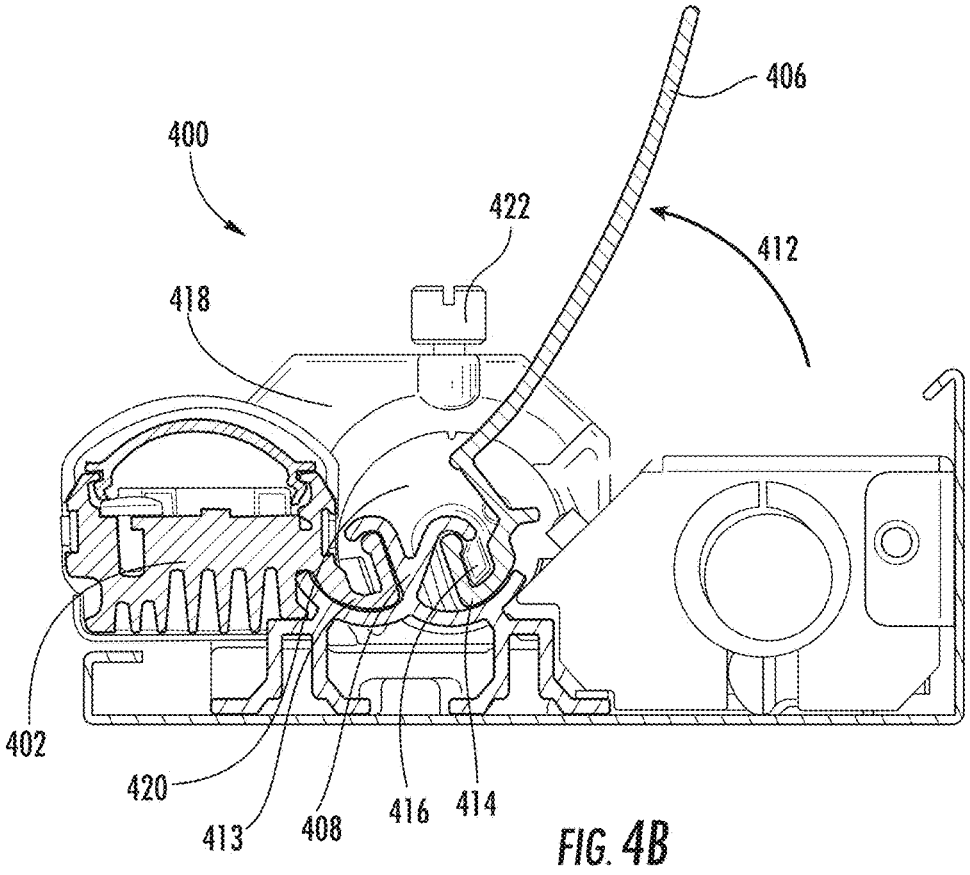

FIG. 4A depicts another cross-sectional view of luminaire 100. In one example, FIG. 4A depicts a second configuration of light source array 202, compared to that first configuration of light source array 202 from FIG. 3. Accordingly, arrow depicts a schematic arc 404 through which light source array 202 may be rotated about bracket structure 303. In one implementation, light source array 202 may rotate relative to bracket structure 303 (along arc 404) through a range of rotation. As such, those of ordinary skill in the art will recognize that the various implementations may be utilized with any ranges of rotation, without departing from the disclosures described herein. Accordingly, the light source array 202 may rotate relative to the bracket structure 303 through any range of rotation, and any angular values presented in this disclosure are merely by way of example, and should not be construed as limiting the described disclosures to the presented angular values. Similarly, FIG. 4B depicts a second configuration of light scoop 204, compared to that first configuration of light scoop 204 from FIG. 3. As such, arrow depicts a schematic arc 412 through which light scoop 204 may be rotated about bracket structure 303. In one implementation, light scoop 204 may rotate relative to bracket structure 303 (along arc 412) through a range of rotation. As such, those of ordinary skill in the art will recognize that the very simple notations may be utilized with any ranges of rotation, without departing from the disclosures described herein. Accordingly, the light scoop 204 may rotate relative to the bracket structure 303 for any range of rotation.

In one implementation, FIG. 4B depicts a lock mechanism bracket 212 having a lock mechanism bearing 420 and a lock mechanism sleeve 416 configured to receive a portion of a hinge arm 307 of light scoop 204. As such, lock mechanism sleeve 416 is configured to rotate with that lock mechanism bearing 420 as the hinge arm 307 rotates within the bracket structure 303. Furthermore, actuation of a thumb screw 214 may selectively couple the lock mechanism bearing 420 to the lock mechanism bracket 212 such that rotation of the lock mechanism sleeve 416, the hinge arm 307, and light scoop 204, is prevented. Additionally or alternatively, rotation of the light source array 202 and its associated hinge arm 305 may be selectively locked using a same lock mechanism bracket 212, or a second lock mechanism bracket (not pictured).

Figure 5A:
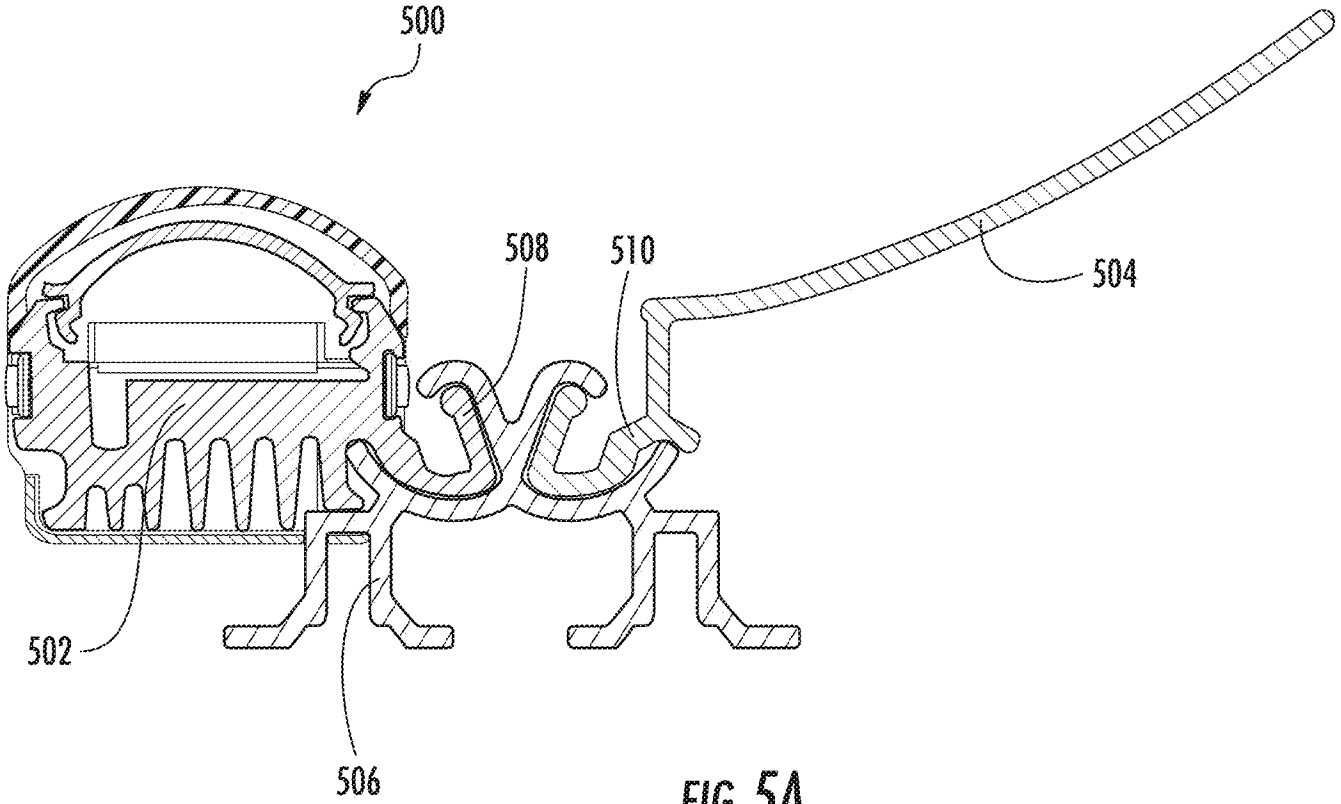
FIG. 5A schematically illustrates a cross-sectional view of an exemplary embodiment of a luminaire according to one or more aspects described herein.

FIG. 5A depicts the internal structure of luminaire 100. Accordingly, luminaire 100 may comprise, among others, a light source array 202 rotatably-coupled to a bracket structure 303 by a first hinge arm 305. Additionally, luminaire 100 may comprise a light scoop 204 rotatably-coupled to the bracket structure 303 by a second hinge arm 307. In one example, bracket structure 303 comprises a uniform cross-sectional area when depicted in that orientation shown in FIG. 5A. Similarly, one or more of the first hinge arm 305 and second hinge arm 307 may also comprise uniform cross-sectional areas, when depicted in that orientation shown in FIG. 5A.

Figure 5B:
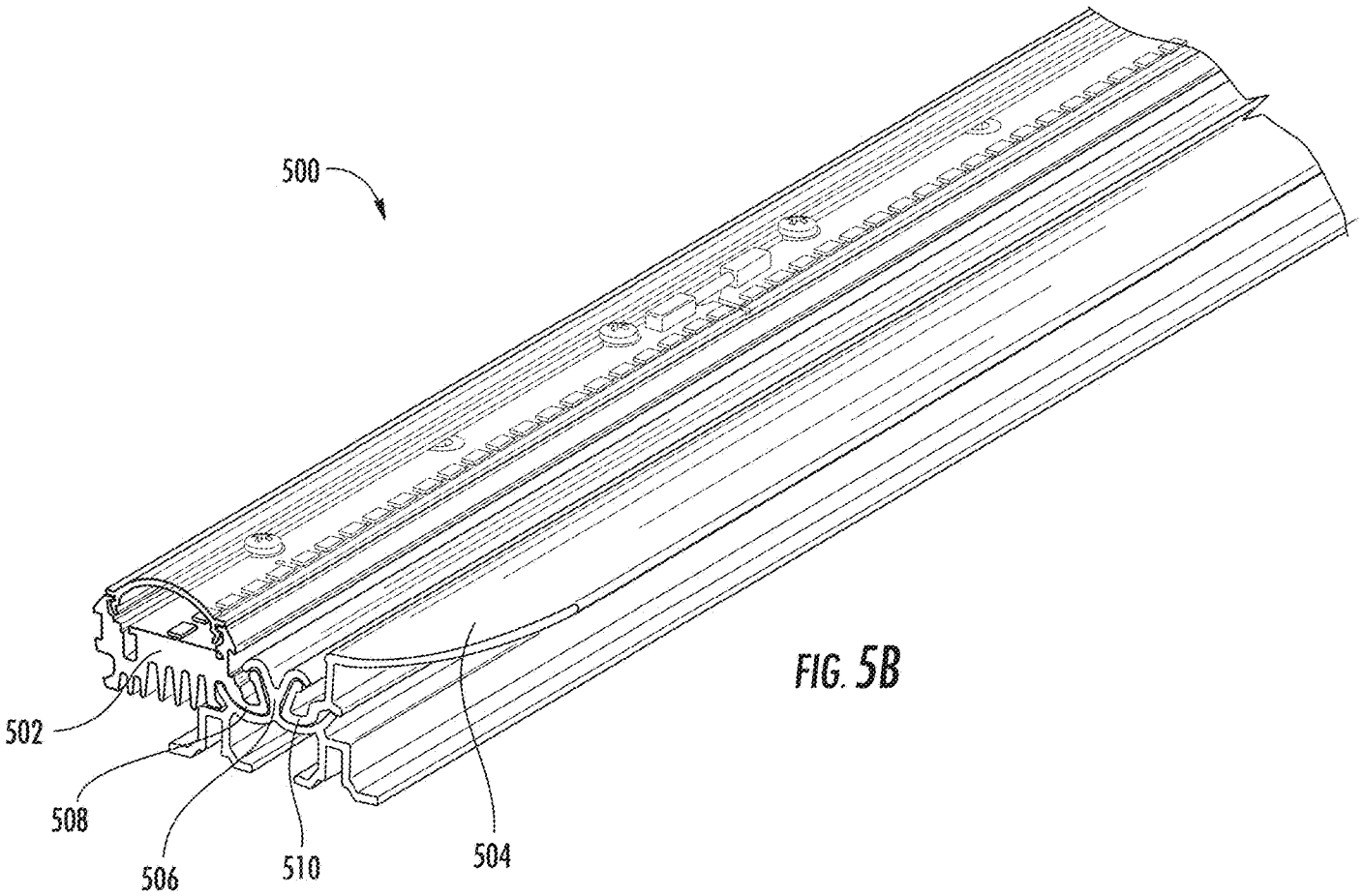
FIG. 5B depicts an isometric view of the exemplary luminaire embodiment from FIG. 5A.

FIG. 5B depicts an isometric view of luminaire 100. As such, FIG. 5B illustrates a uniform cross-sectional area of one or more of the first hinge arm 305 associated with light source array 202, the bracket structure 303, and/or the second hinge arm 307 associated with light scoop 204.

Figure 6:
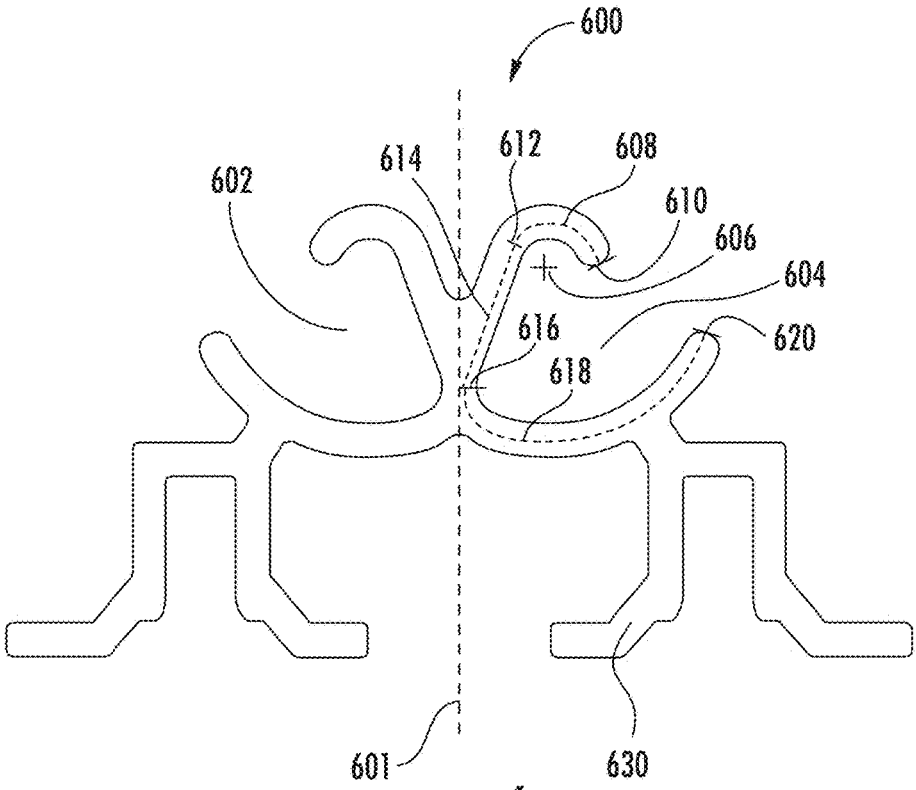
FIG. 6 depicts a cross-sectional view of a bracket structure according to one or more aspects described herein.

FIG. 6 depicts a cross-sectional view of the bracket structure 303. In one example, bracket structure 303 comprises a symmetrical cross-sectional area about center line 601. In one implementation, bracket structure 303 comprises a first hinge channel 602 and a second hinge channel 604. As such, in one example, the first hinge channel 602 is configured to receive a first hinge arm, such as hinge arm 305 associated with a light source array 202, and configured to form a first nested circular hinge. Similarly, in one example, the second hinge channel 604 is configured to receive a second hinge arm, such as hinge arm 307 associated with light scoop 204, and configured to form a second nested circular hinge.

In one example, the hinge channel 604 comprises a center of curvature 606. Furthermore, the hinge channel 604 may comprise a hook structure 608 having an open end 610 and a tangential end 612. The hinge channel 604 further comprises a linear backstop structure 614 having a proximal end, corresponding to the tangential end 612, and a distal end 616. The hinge channel 604 further comprises an outer sleeve structure 618 with a first end corresponding to the distal end 616 of backstop structure 614, and a second end 620. Additionally, bracket structure 303 may comprise a support structure 630 configured to rigidly couple the bracket structure 303 to a support surface of a housing structure, such as housing structure 206. Furthermore, it will be apparent that one or more surfaces may make up a structure, as described herein, and such that the terms "structure" and "surface" may be used interchangeably in certain instances.

Figure 7:
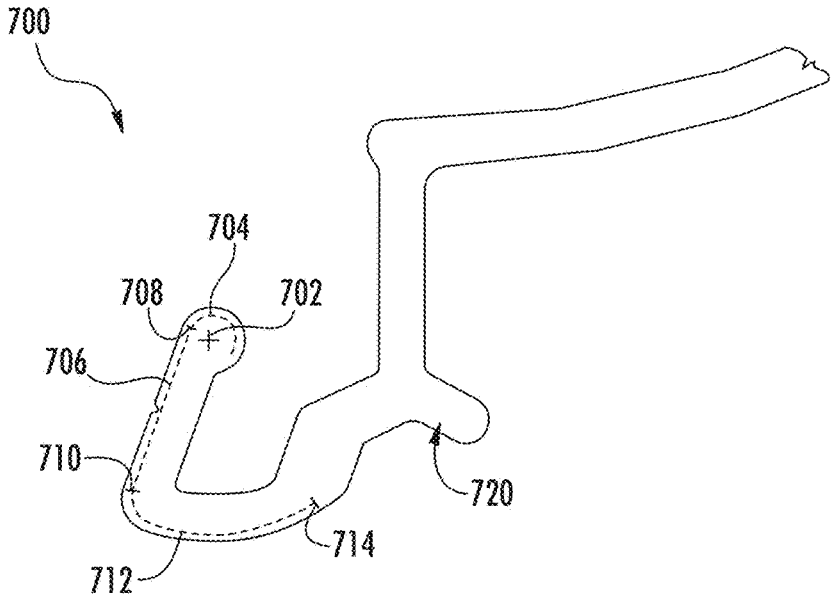
FIG. 7 depicts a cross-sectional view of a hinge arm according to one or more aspects described herein.
Figure 8A:
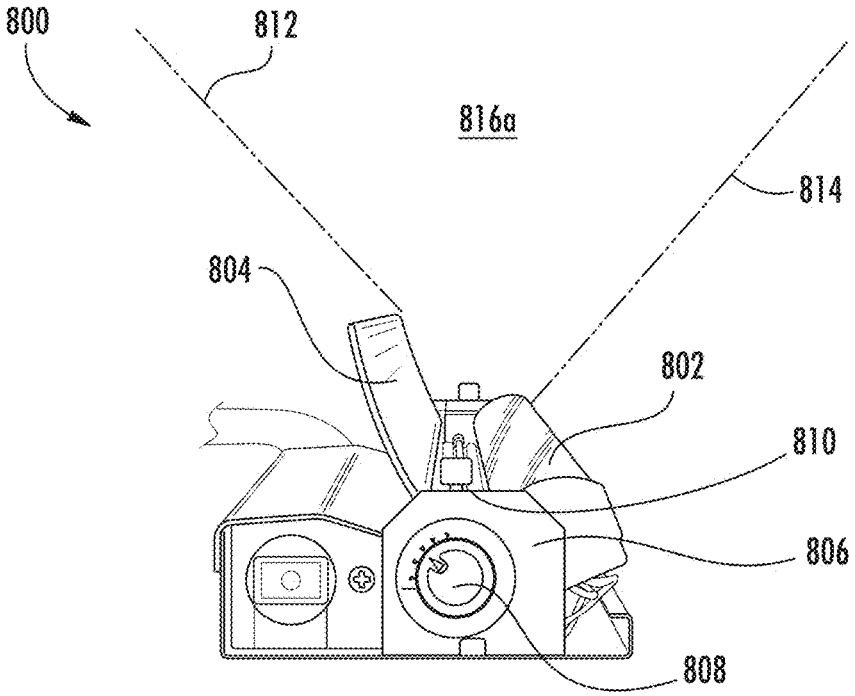
FIGS. 8A-8F depict various configurations of an exemplary embodiment of a luminaire according to one or more aspects described herein.
Figure 8B:
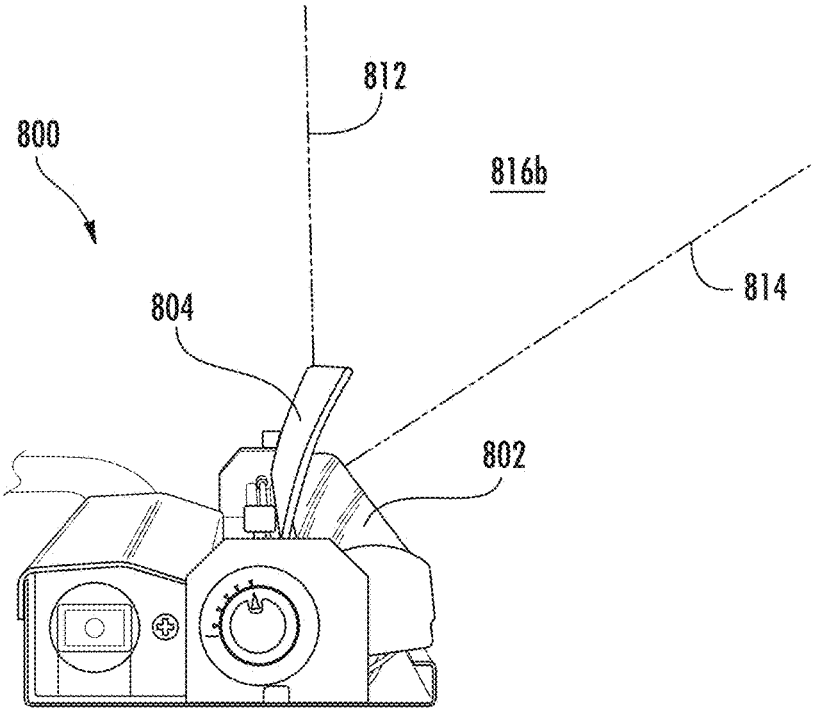
Figure 8C:
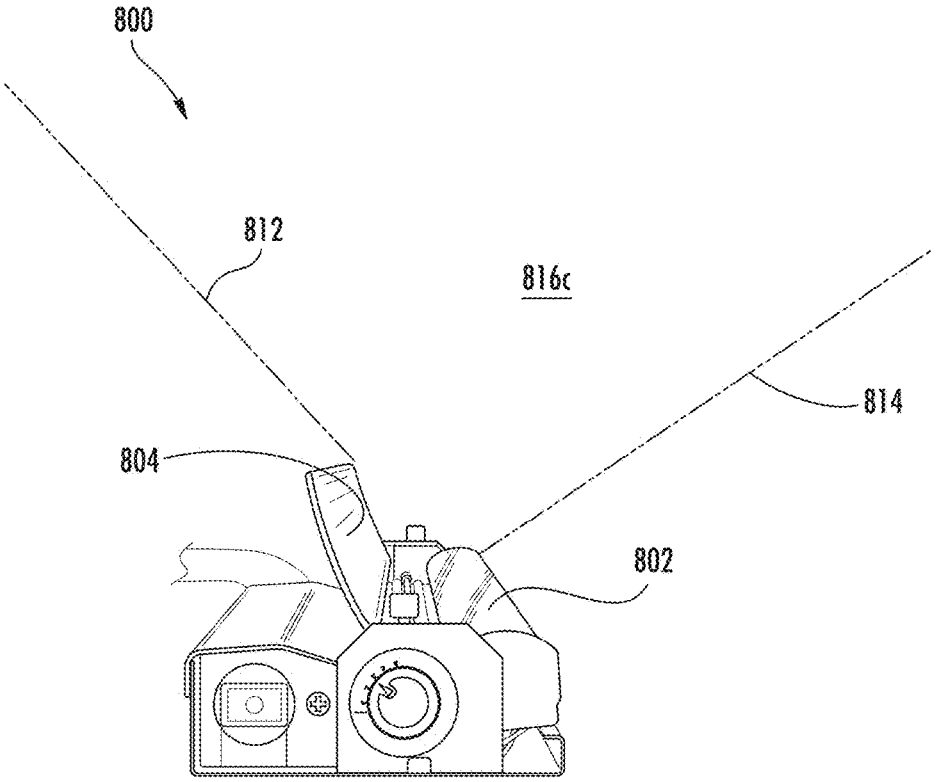
Figure 8D:
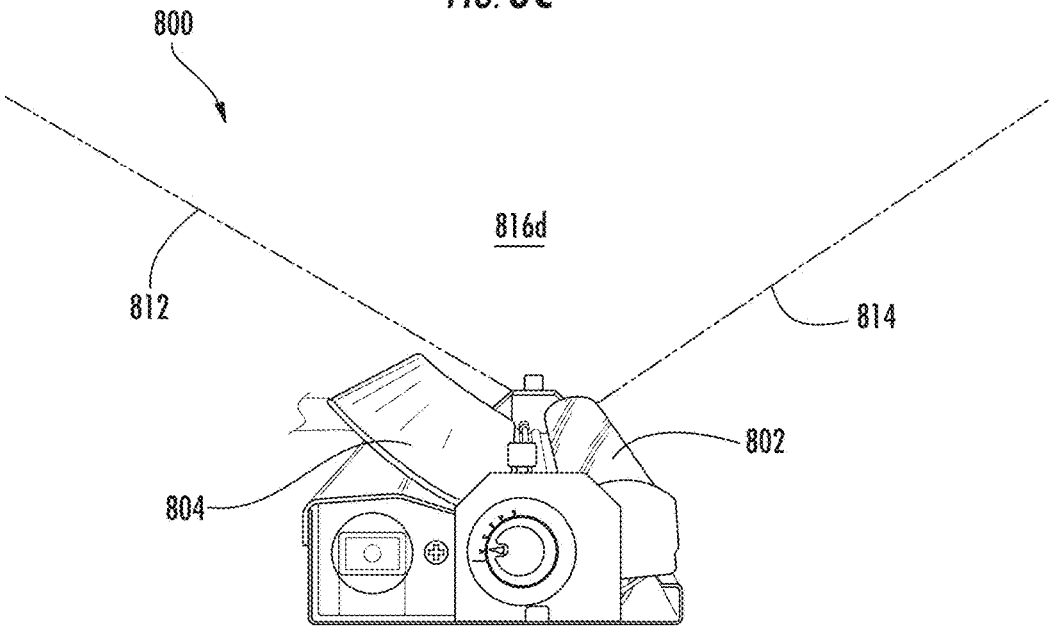
Figure 8E:
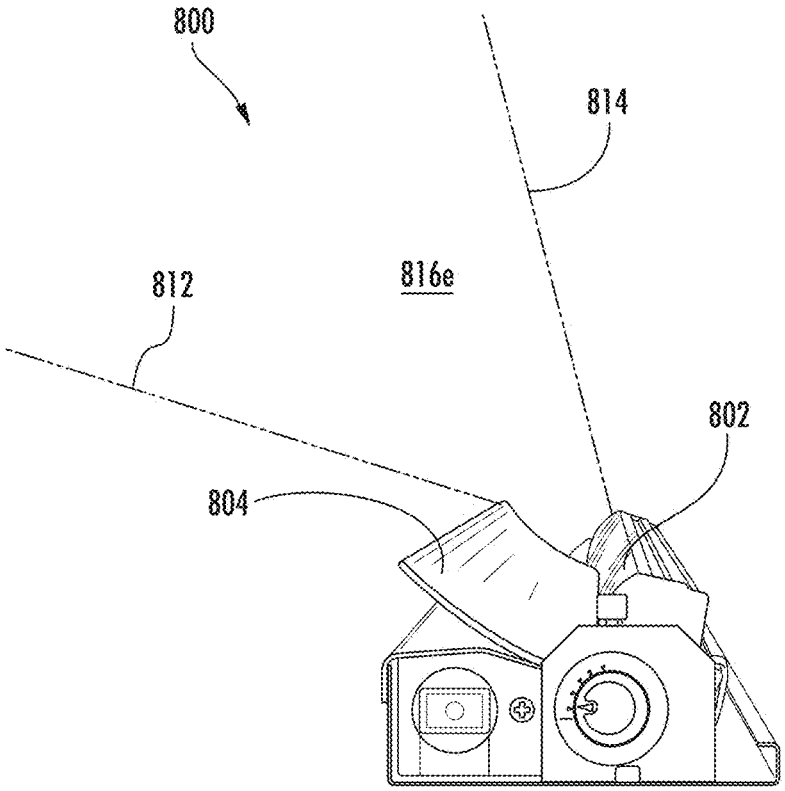
Figure 8F:
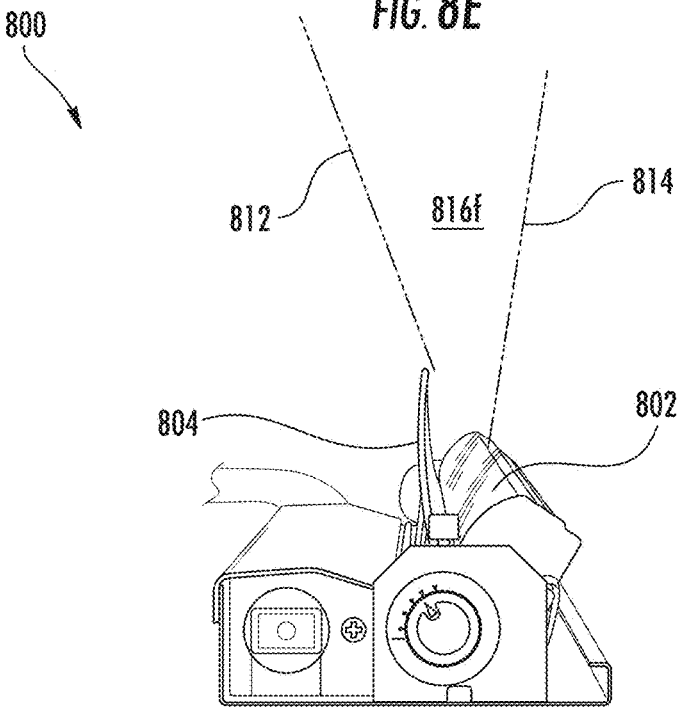

FIG. 7 depicts a cross-sectional view of a hinge arm 307. In particular, hinge arm 307 comprises a center of curvature 702. As such, hinge arm 307 has a pivot structure 704, and a radial arm structure 706 that is coupled to the pivot structure 704 at point 708, and coupled to a circular arm structure 712 at point 710. Said circular arm structure 712 further comprises a second end 714. Accordingly, in one example, pivot structure 704 comprises a circular structure having a center of curvature corresponding to the center of curvature 702. In one implementation, circular arm structure 712 also has a center of curvature corresponding to that center of curvature 702.

In one implementation, the first hinge channel 602 and/or the second hinge channel 604 from the bracket structure 303, as depicted in FIG. 6, are configured to receive the hinge arm 307. Accordingly, a rotatable coupling between the bracket structure 303 and the hinge arm 307 is schematically depicted in FIG. 5A by the rotatable coupling between bracket structure 303 and one or more of the depicted hinge arms 305 and 307. In one example, when hinge arm 307 is received into hinge channel 604 of bracket structure 303, the center of curvature 606 approximately coincides with the center of curvature 702. However, those of ordinary skill in the art will recognize that the described coupling of hinge channel 604 and hinge arm 307 may include engineering/manufacturing tolerances, and such that there may exist some degree of variation between the coupling of hinge channel 604 and hinge arm 307. In one example, an engineering tolerance may be +/−20% of a given dimension, and the like.

In one example, a hinge arm, such as hinge arm 307, is configured to be received into a hinge channel, such as hinge channel 604 of bracket structure 303, with an interference fit. In another example, a hinge arm 307 is configured to be received into hinge channel 604 with a loose fit, and such that an angle of rotation of, in one example, a light scoop 204 relative to a bracket structure 303, is maintained by selectively coupling the light scoop 204 to the bracket structure 303 using a lock mechanism to rigidly couple the light scoop 204 to the bracket structure 303. In one example, this selective coupling may be facilitated by lock mechanism 212 from FIG. 2.

In one example, pivot structure 704 is configured to rotate about a center of curvature 702 and slide relative to hook structure 608. Additionally, circular arm structure 712 is configured to rotate about the same center of curvature 702 and slide relative to outer sleeve structure 618 of hinge channel 604. In a first configuration, and as schematically depicted in FIG. 5A by the relative positioning of hinge arm 307 and bracket structure 303, the radial arm structure 706 is configured to contact the linear backstop structure 614 of the hinge channel 604. In a second configuration, and as schematically depicted in FIG. 4B by the relative positioning of the hinge arm 307 relative to the bracket structure 303, the radial arm structure 706 is configured to be spaced apart from the linear backstop structure 614 of the hinge channel 604. In another example, hinge arm 307 comprises a stop 720 configured to contact endpoints 620 of outer sleeve structure 618 when configured in the first configuration described above.

FIGS. 8A-8F depict various configurations of a luminaire 100. In one example, luminaire 100 may comprise a light source array 202, and a light scoop 204. In one example, luminaire 100 comprises a lock mechanism bracket 212, similar to lock mechanism 212 from FIG. 2. As such, in one example, luminaire 100 further comprises an angle gauge and bearing 420 configured to display an angle of rotation of one or more of light source array 202 and/or light scoop 204. Furthermore, luminaire 100 may comprise a screw mechanism 214 configured to allow selective locking of one or more of light source array 202 and/or light scoop 204. Accordingly, in one example, one or more of the light source array 202 and/or the light scoop 204 may rotate through an angle of 50° or more. In another example, one or more of the light source array 202 and/or the light scoop 204 may rotate through an angle of 70° or more. In yet another example, one or more of the light source array 202 and/or the light scoop 204 may rotate through an angle of 90°.

In one example, and as previously described, an orientation/rotation angle of one or more of light source array 202 and/or light scoop 204 may be adjustable to provide for variable directionality for a portion of light emitted from light source array 202. In another example, the orientation/rotation angle of one or more of the light source array 202 and/or light scoop 204 may be adjusted to provide for adjustable lighting "envelopes," or areas of illumination, and the like. As such, lines 812 and 814 schematically depict bounds of an area of illumination by luminaire 100. As such, area 816 represents an area illuminated by a one or more light sources (such as light sources 208*a* and 208*b*) associated with light source array 202. Accordingly, FIGS. 8A-8F depict various configurations of the independently-rotatable light source array 202 and light scoop 204, wherein areas 816*a*-816*f* schematically illustrate different areas of illumination that may be achieved by adjusting one or more of an angle of rotation of the light source array 202 and/or light scoop 204. Furthermore, those of ordinary skill in the art will recognize that the depicted configurations of luminaire 100 are not limited to those depicted in FIGS. 8A-8F, wherein an angle of rotation of one or more of light source array 202 and/or light scoop 204 may be infinitely adjustable between a lower angular bound (which may be referred to as an angle of approximately 0°, and the like) and an upper angular bound. Accordingly, those of ordinary skill in the art will recognize that these described implementations may be utilized with any angular values without departing from the scope of the disclosures described herein. Accordingly, an upper angular bound may be associated with any angular value, and such that an angular range through which the light source array 202 and/or the light scoop 204 may be adjusted may have any value. Additionally, it will be readily apparent to those of ordinary skill that an illuminated area, such as area 816*a* from FIG. 8A, may not be strictly bounded by those lines 812 and 814. In other words, there may exist a gradient between an area in shadow, and that illuminated area 816*a*, and such that lines 812 and 814 do not represent a sharp boundary between the illuminated area 816*a* and an area in shadow, and the like.

Figure 9A:
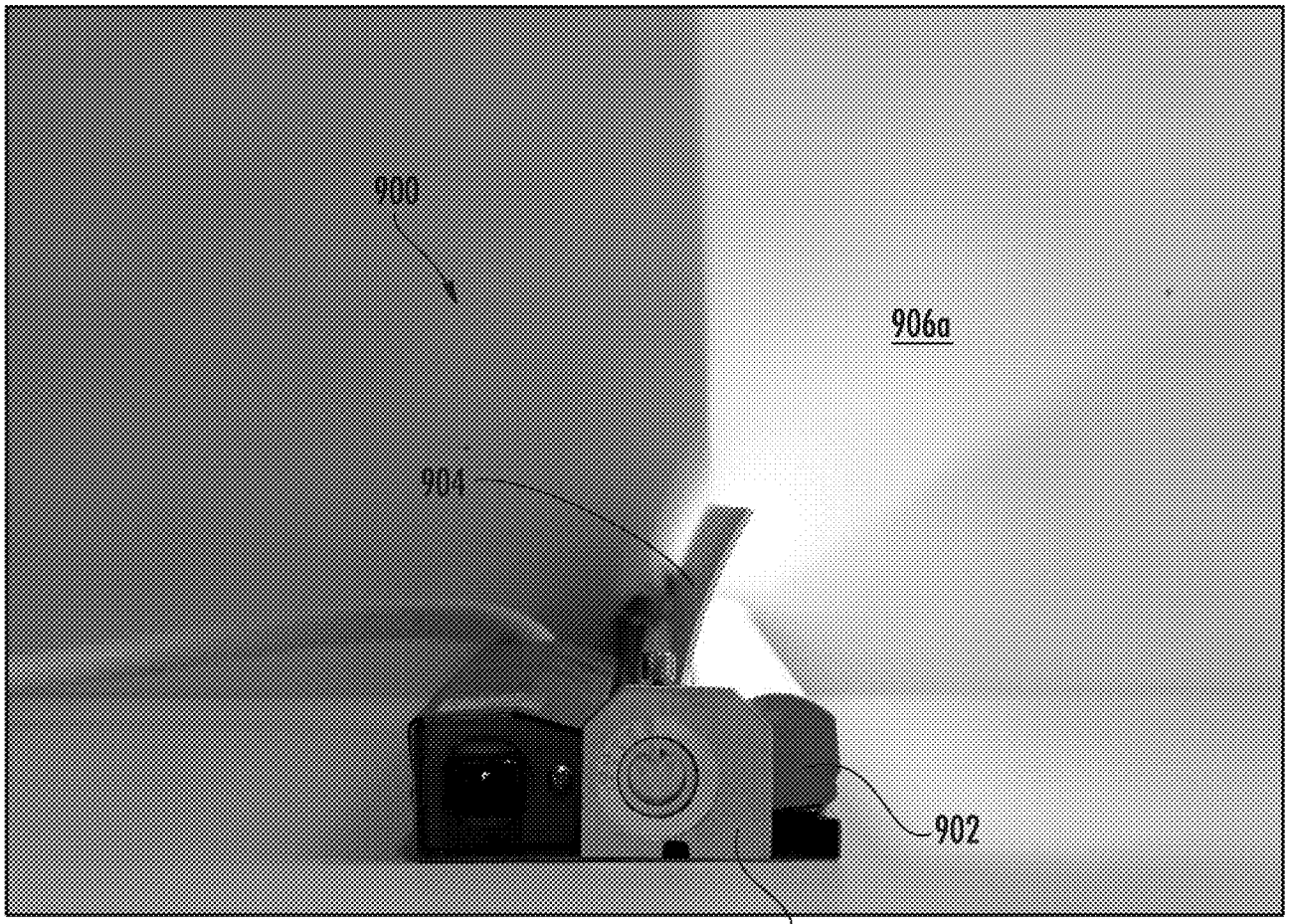
FIGS. 9A-9B depict two configurations of a luminaire in operation according to one or more aspects described herein.
Figure 9B:
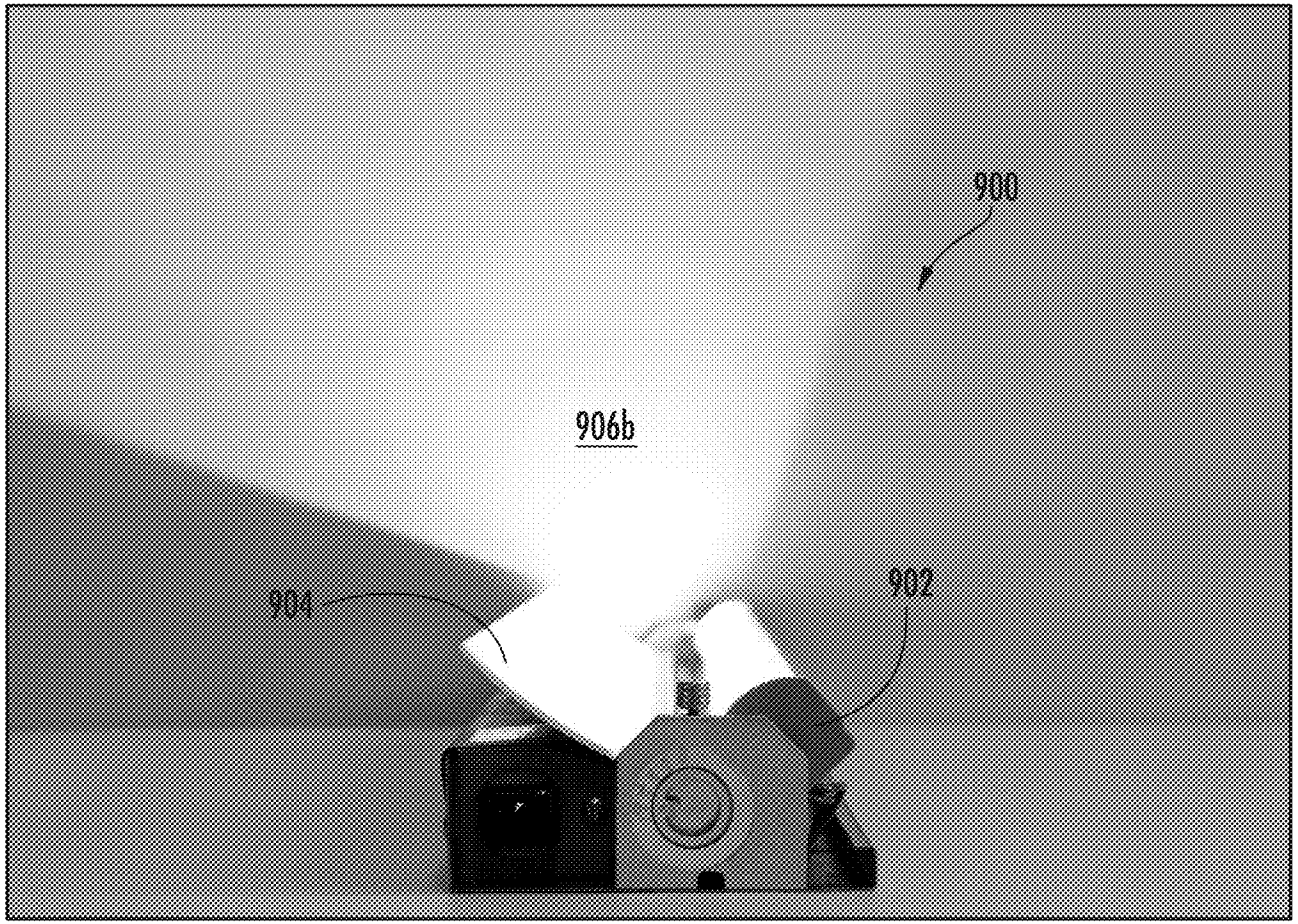

FIGS. 9A-9B depict two configurations of luminaire 100 in operation. As such, luminaire 100 comprises a light source array 202, a light scoop 204, and a lock mechanism bracket 212, among others. In that first configuration depicted in FIG. 9A, luminaire 100 illuminates that area 906*a*. In a second configuration, such as that configuration depicted in FIG. 9B, luminaire 100 illuminates area 906*b*, wherein the size and direction of area 906*b* differs from that of area 906*b* due to a difference in an angle of rotation of one or more of light source array 202 and/or light scoop 204 in FIG. 9B as compared to FIG. 9A.

Figure 10A:
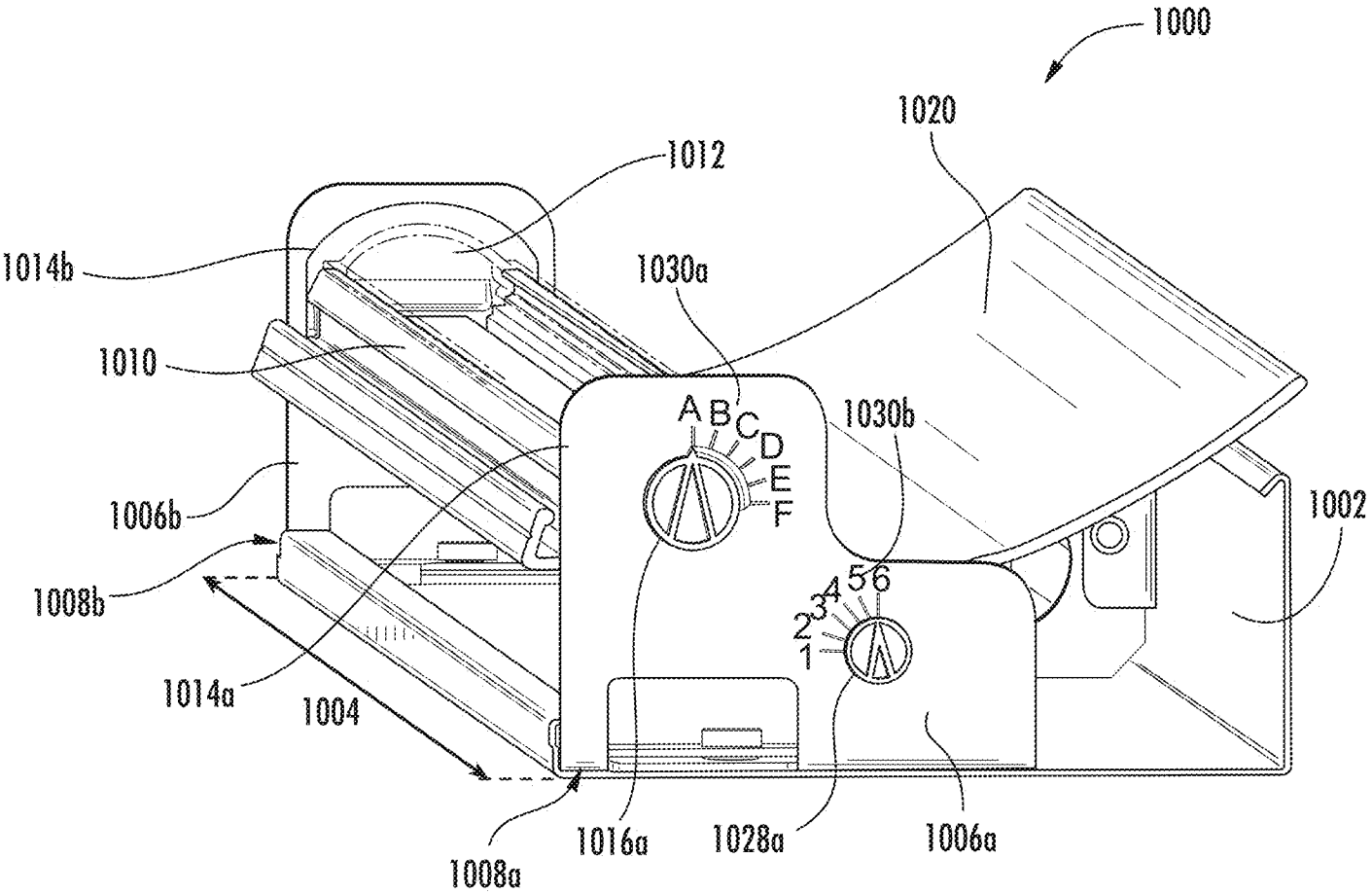
FIGS. 10A-10C depict another implementation of a luminaire according to one or more aspects described herein.
Figure 10B:
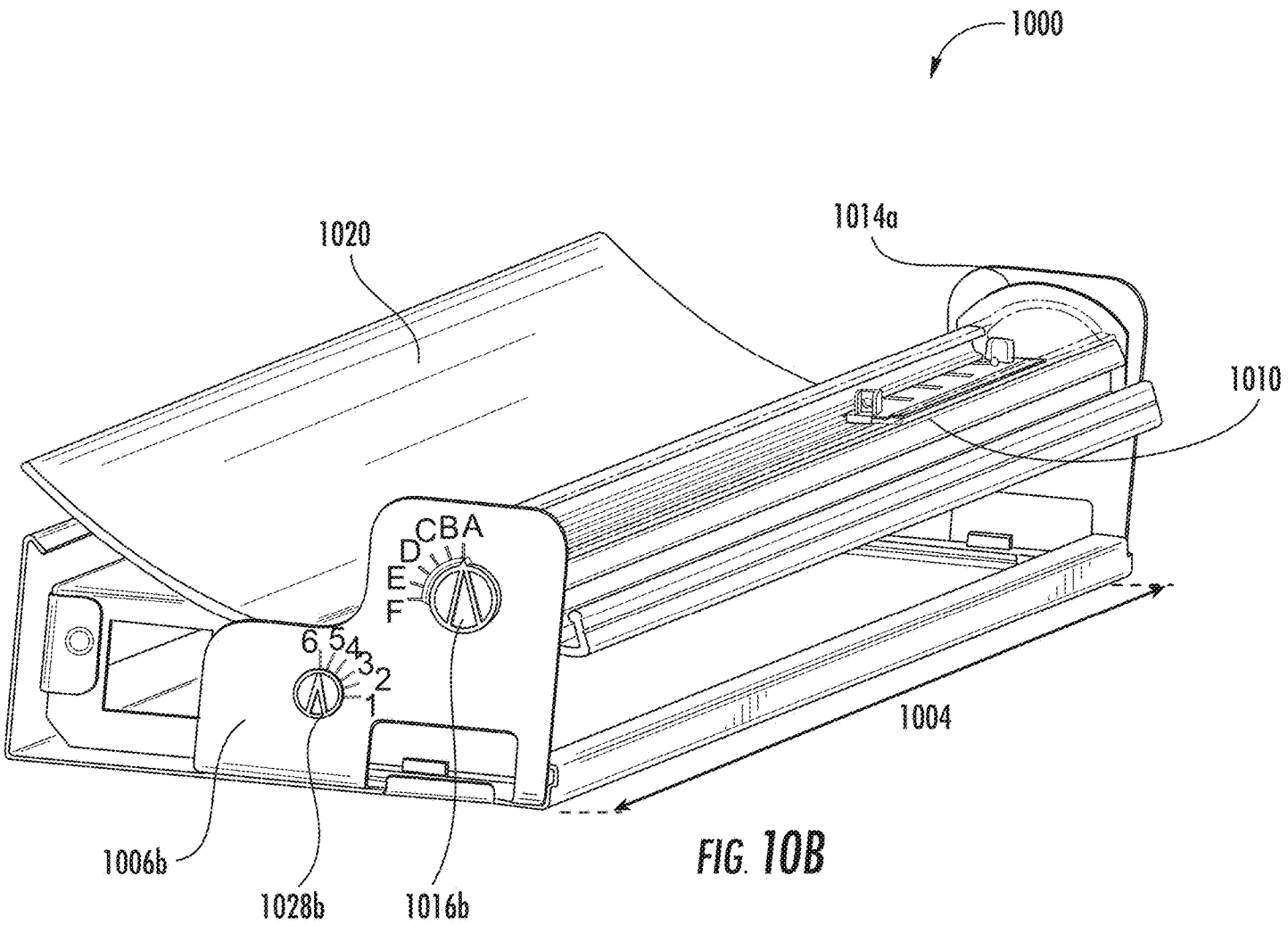
Figure 10C:
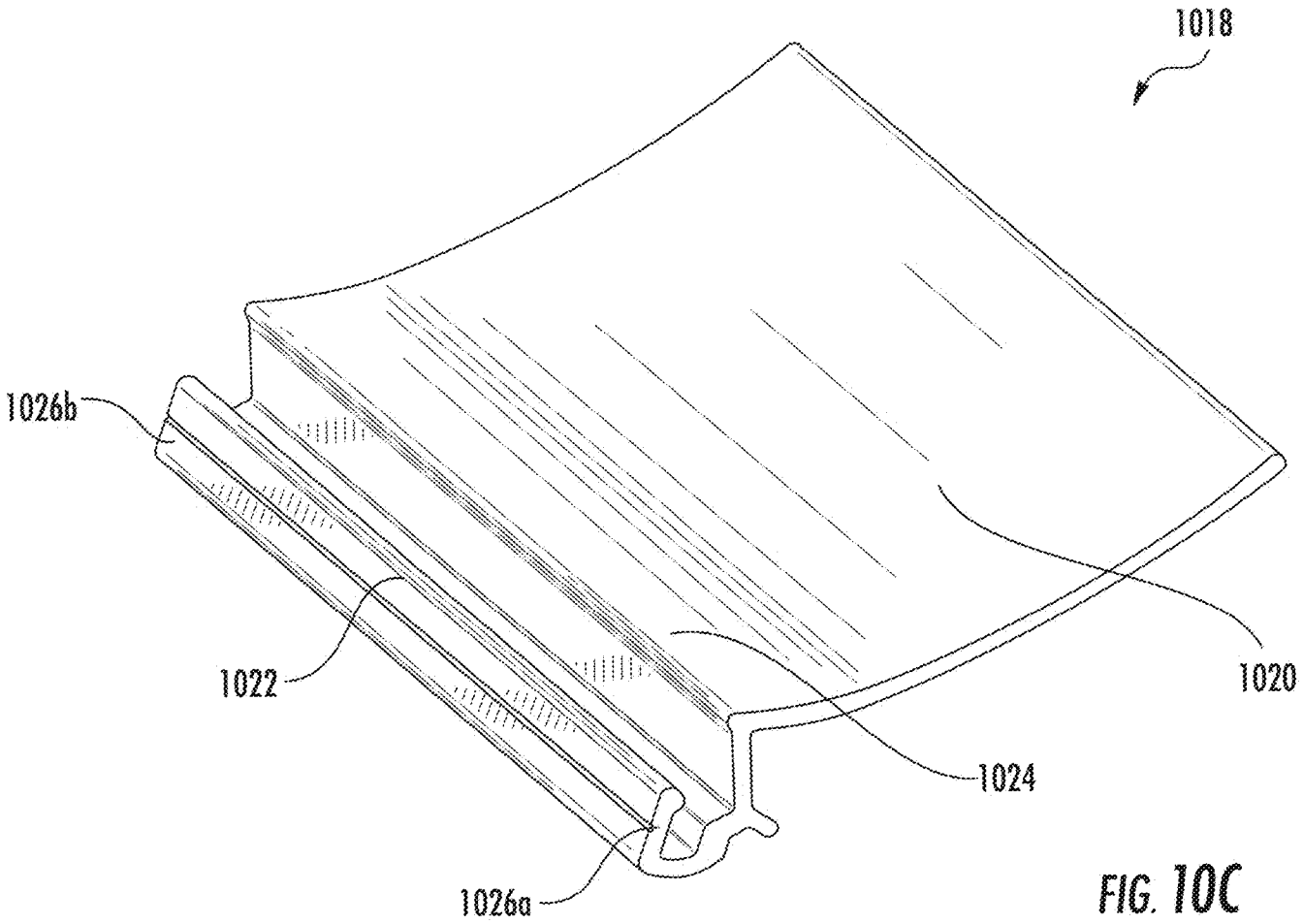

FIGS. 10A-10C depict another implementation of a luminaire. In particular, luminaire 1000 may have a housing structure 1002 with a longitudinal length 1004. In one example, this housing structure 1002 may be similar to housing structure 206. As such, in one implementation, housing structure 1002 may be constructed from one or more of a metal, an alloy, a polymer, a fiber-reinforced material, a wooden material, or a glass, among others. In one specific example, housing structure 1002 may be constructed from a steel sheet metal material, and the like. As such, those of ordinary skill in the art will recognize that any construction material and/or technique may be utilized to construct luminaire 1000 without departing from the scope of the disclosures described herein. Further, luminaire 1000 may be constructed with any dimensional values, such that longitudinal length 1004 may be embodied with any length, without departing from the scope of the disclosures described herein.

In one implementation, luminaire 1000 comprises a first bracket 1006*a* coupled to a first end 1008*a*, and a second bracket 1006*b* coupled to a second end 1008*b* of the housing structure 1002. The luminaire 1000 may further have a light bar structure 1010 comprising a plurality of light sources. As such, light bar structure 1010 may be similar to light source array 202. Further, light bar structure 1010 may comprise a plurality of light sources configured into a one-dimensional, two-dimensional, or three-dimensional array. In one specific example, light bar structure 1010 may comprise a plurality of light-emitting diodes (LEDs). In one embodiment, the light bar structure 1010 may comprise a lens structure 1012, and configured to adjust the light emitted from the light bar structure 1010. In this way, the lens structure 1012 may be similar to lens structure 207, previously described.

In one example, the light bar structure 1010 has a first end 1014*a* spaced apart from a second end 1014*b* along the longitudinal length 1004. Further, the light bar structure 1010 may be rotatably-coupled to the first bracket 1006*a* at the first end 1014*a* by a first bearing element 1016*a*. Similarly, the light bar structure 1010 may be rotatably-coupled to the second bracket 1006*b* at the second end 1014*b* by a second bearing element 1016*b*. Those of ordinary skill in the art will recognize that the first bearing element 1016*a* and the second bearing element 1016*b* may comprise any bearing structure known to those of ordinary skill in the art, including, among others, a ball bearing, or a bearing comprising a sleeve (configured as part of the brackets 1006*a* and 1006*b*) configured to receive a shaft that is rigidly-coupled to the light bar structure 1010, and such that the shaft is configured to rotate relative to the sleeve through use of one or more low friction materials. In one example, the first bearing element 1016*a* and the second bearing element 1016*b* may be configured to form an interference fit with each of the first bracket 1006*a* and the second bracket 1006*b*. As such, this described interference fit may resist rotational motion of the light bar structure 1010, e.g. rotational motion of the light bar structure 1010 due to a weight of the light bar structure 1010. In one example, the described interference fit between the light bar structure 1010 and the first and second brackets 1006*a* and 1006*b* may resist rotational motion of the light bar structure 1010 relative to the brackets 1006*a* and 1006*b* until a manual rotational force is applied to the light bar structure 1010, thereby overcoming a friction force in the first and second bearing elements 1016*a* and 1016*b*.

In one implementation, the luminaire 1000 comprises a reflector structure 1018. As such, in one example, the reflector structure 1018 comprises a light scoop 1020 and a spine structure 1022, such that the spine structure 1022 is rigidly-coupled to a proximal side 1024 of the light scoop 1020. In one implementation, the spine structure 1022 has a first end 1026*a* configured to be rotatably-coupled to the first bracket structure 1006*a* by a third bearing element 1028*a*, and a second end 1026*b* configured to be rotatably-coupled to the second bracket structure 1006*b* by a fourth bearing element 1028*b*. Accordingly, in one example, the third and fourth bearing elements 1028*a* and 1028*b* may be similar to the first and second bearing elements 1016*a* and 1016*b*. As such, the third and fourth bearing elements 1028*a* and 1028*b* may be configured to resist rotational motion of the reflector structure 1018 due to a weight of the reflector structure 1018 exerted on the third and fourth bearing elements 1028*a* and 1028*b*. Accordingly, the reflector structure 1018 may be configured to rotate relative to the third and fourth bearing elements 1028*a* and 1028*b* upon application of a manual rotational force to the reflector structure 1018. Further, in one example, the light scoop 1020 may be similar to light scoop structure 204.

Figure 11:
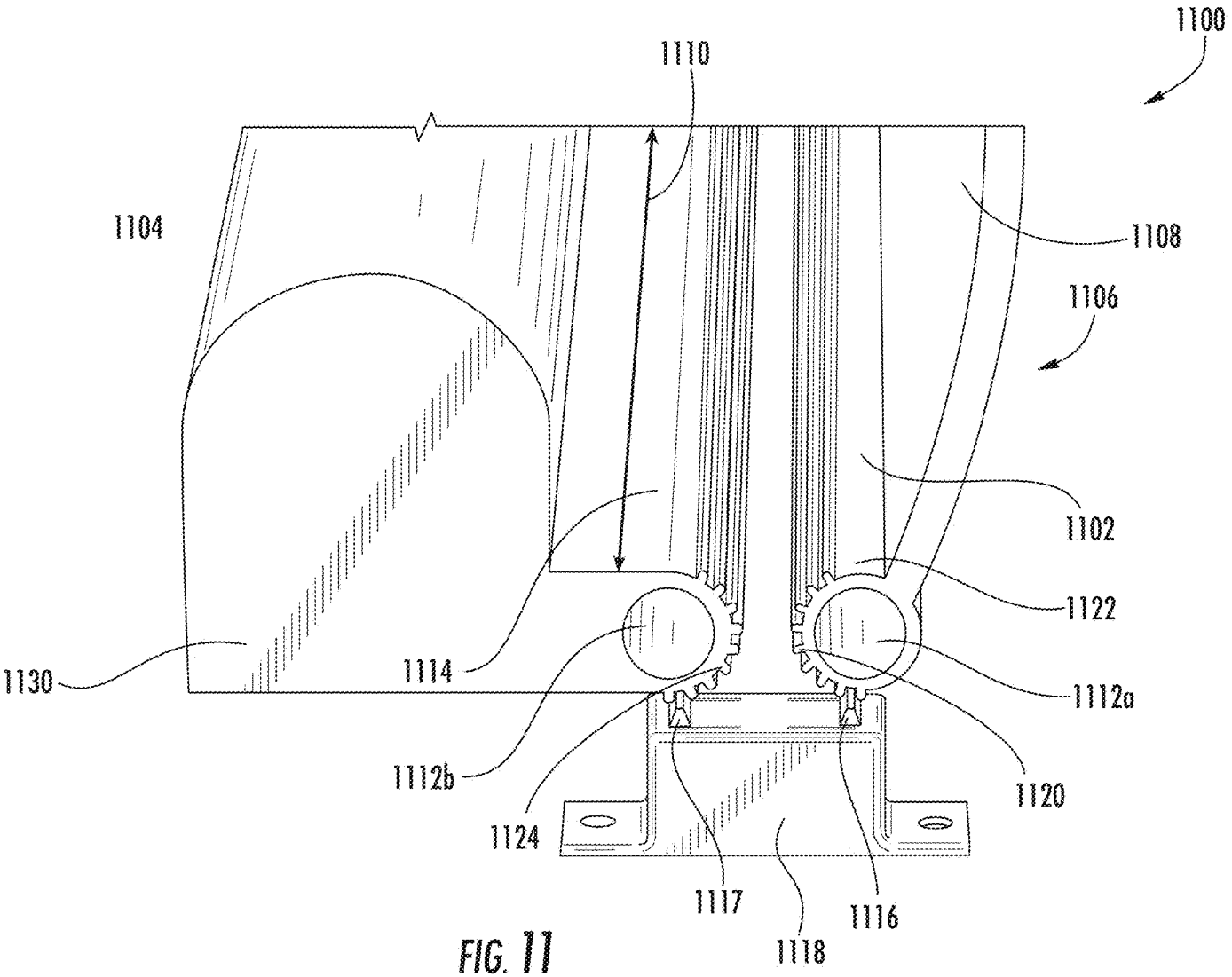
FIG. 11 schematically depicts an alternative implementation of a luminaire according to one or more aspects described herein.

In one example, the reflector structure 1018 may have a uniform cross-sectional area along the longitudinal length 1004 of the housing structure 1002. Accordingly, in one example, the reflector structure 1018, and in particular, the spine structure 1022, may have a geometry similar to that described in relation to the second hinge arm 307 from FIG. 7. However, in another implementation, the spine structure 1022 may be embodied with one or more additional or alternative geometrical structures. For example, the spine structure 1022 may be configured to have a simple rod-like shape extending along the longitudinal length 1004 of the housing structure 1002. As such, this rod-like shape may be similar to the geometry of spine element 1102 (otherwise referred to as a hinge structure 1102) that is schematically depicted in FIG. 11.

In one implementation, each of the reflector structure 1018 and the light bar structure 1010 may be configured to rotate relative to the housing structure 1002. As such, an angle of rotation of the light bar structure 1010 may be adjustable independently of an angle of rotation of the reflector structure 1018.

In one implementation, the first bracket 1006*a* comprises a first scale 1030*a* and a second scale 1030*b* configured to indicate an angle of rotation of the light bar structure 1010 and the light scoop 1020, respectively. Similarly, the second bracket 1006*b* may be configured with similar scales to those scales 1030*a* and 1030*b*, and the like. Further, those of ordinary skill in the art will recognize that the light bar structure 1010 and/or the light scoop 1020 may be configured to rotate through any rotational angle range, without departing from the scope of the disclosures described herein. For example, the light bar structure 1010 and/or the light scoop 1020 may be configured to rotate through an angular range of 70°, 80°, 90°, 100°, or 110°. Further, an angular range through which the light bar structure 1010 may be rotated may be different to an angular range through which the light scoop 1020 may be rotated, without departing from the scope of the disclosures described herein.

In one implementation, a position of the light bar structure 1010 and/or the reflector structure 1018 may be selectively locked using a locking mechanism (not shown). Accordingly, those of ordinary skill in the art will recognize various locking mechanisms that may be utilized with the disclosures of FIGS. 10A-10C, without departing from the scope of the disclosures described herein. In one specific example, a locking mechanism similar to that thumb screw 214 may be utilized with a luminaire 1000, and the like.

Figure 12:
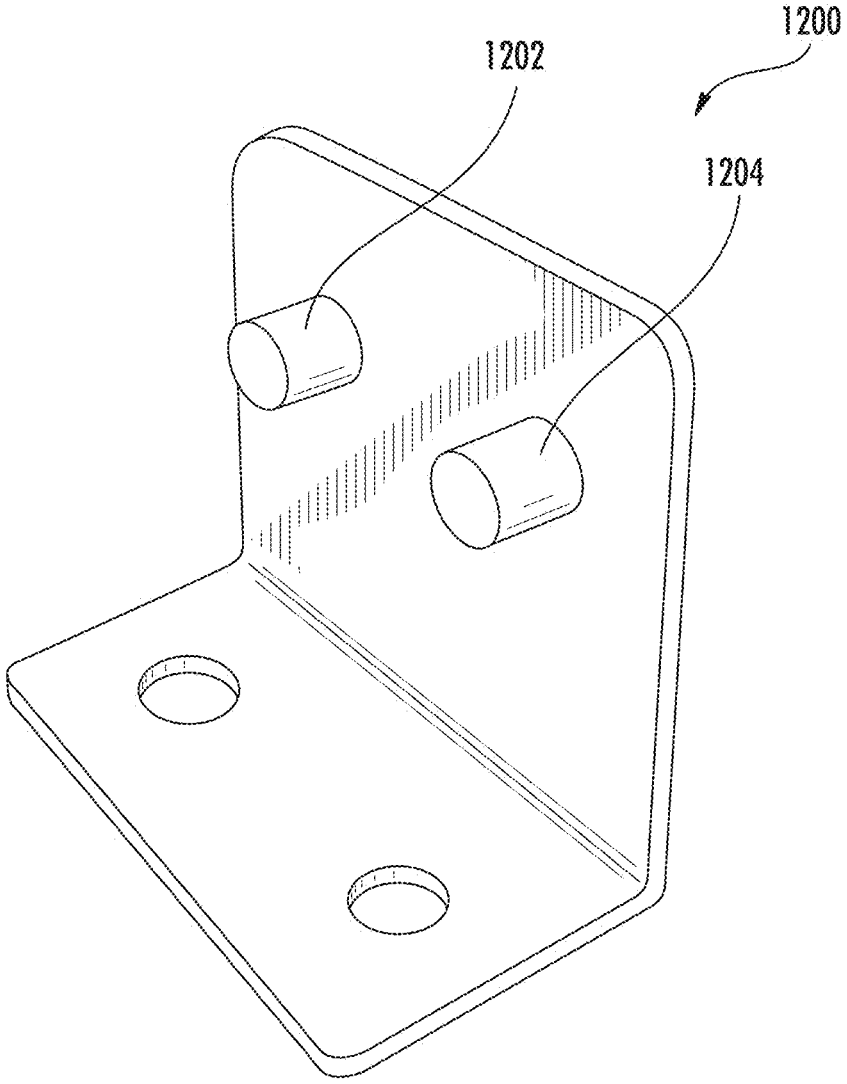
FIG. 12 depicts a bracket structure according to one or more aspects described herein.

FIG. 11 schematically depicts an alternative implementation of a luminaire 1100. In particular, the schematic implementation of luminaire 1100 comprises a light bar structure 1104, and a reflector structure 1106. Accordingly, the light bar structure 1104 may be similar to the light bar structure 1010 from FIGS. 10A and 10B. Further, the reflector structure 1106 may be similar to the reflector structure 1018 depicted in FIG. 10C. As such, the reflector structure 1106 may comprise a light scoop 1108, similar to the light scoop 1020, and a hinge structure 1102. In one example, the hinge element 1102 extends along a longitudinal length of the luminaire 1100, with said longitudinal length schematically-illustrated by arrow 1110. In particular, the hinge structure 1102 may comprise a cylindrical structure configured with a first opening 1112*a*. In one example, rotation of the reflector structure 1106 may be about a center axis of the circular opening 1112*a*. Accordingly, in one example, the first opening 1112*a* may be configured to receive a first peg 1202 of a bracket structure 1200, as schematically depicted FIG. 12. In this way, the circular opening 1112*a* may be configured to rotate relative to the first peg structure 1202 of the bracket structure 1200. In one example, the circular opening 1112*a* of the hinge structure 1102 may loosely rotate relative to the first peg structure 1202.

Similar to the reflector structure 1106, the light bar structure 1104 may rotate utilizing a hinge structure 1114, similar to the hinge structure 1102. As such, the hinge structure 1114 may have a second opening 1112*b* configured to receive a second peg structure 1204 of the bracket structure 1200 depicted in FIG. 12. Accordingly, in one example, a rotatable coupling between the hinge structure 1102, the hinge structure 1114, and the bracket structure 1200 from FIG. 12 may not be configured to resist motion of one or more of the reflector structure 1106 and/or the light bar structure 1104. As such, in one implementation, the luminaire 1100 comprises a hinge retention structure 1118 that is configured to resist motion of hinge structure 1102 and hinge structure 1114, thereby resisting rotational motion of the light bar structure 1104 and/or the reflector structure 1106. In particular, the hinge retention structure 1118 may comprise a first tab 1116 and a second tab 1117. Accordingly, in one example, the first tab 1116 may be configured to engage between a selected pair of a first plurality of teeth 1120 of the hinge structure 1102. As such, the first plurality of teeth 1120 may be configured in a circular arc around an outer hinge surface 1122 of the hinge structure 1102. As such, engagement between the first tab structure 1116 and a selected pair of the first plurality of teeth 1120 of the hinge structure 1102 may be configured to resist rotation of the reflector structure 1106 under a weight of the reflector structure 1106. In one implementation, upon application of a manual rotational force to the reflector structure 1106, the first tab structure 1116 may be configured to retract into the hinge retention structure 1118, thereby allowing the hinge structure 1102 to rotate relative to the first peg structure 1202. In one example, retraction of the first tab structure 1116 may be facilitated by a flexure structure. However, those of ordinary skill in the art will recognize alternative or additional implementations of the hinge retention structure 1118, without departing from the scope of these disclosures. For example, the first tab structure 1116 may retract into the hinge retention structure 1118 using one or more spring elements, among others. In one implementation, operation of the second tab structure 1117 may be similar to the first tab structure 1116, and such that the second tab structure 1117 may be configured to engage with a selected two of a second plurality of teeth 1124 on the hinge structure 1114. In this way, engagement between the second tab structure 1117 and the selected pair of a second plurality of teeth 1124 on the hinge structure 1114 may be configured to resist rotation of the light bar structure 1104. As such, an angle of rotation of the light bar structure 1104 may be adjusted upon application of a manual rotational force that causes the second tab structure 1117 to disengage from the selected two of the second plurality of teeth 1124.

In one implementation, the light bar structure 1104 may comprise a heat sink structure 1130 that is configured to dissipate heat energy from one or more light sources within the light bar structure 1104, among others.

It is noted that, as used herein, the term "approximately" may indicate a value ranging by plus or minus (+/−) 20% from an indicated value, and the like.

The present invention has been described in terms of preferred and exemplary embodiments thereof. Numerous other embodiments, modifications and variations within the scope and spirit of the appended claims will occur to persons of ordinary skill in the art from a review of this disclosure.

We claim:

1. A luminaire, comprising:

a housing structure having a first end spaced apart from a second end along a longitudinal length;

a first bracket coupled to the first end of the housing structure;

a second bracket coupled to the second end of the housing structure;

a light bar structure comprising a plurality of light sources, the light bar structure having a first end spaced apart from a second end along the longitudinal length of the housing structure, the first end of the light bar structure rotatably-coupled to the first bracket by a first bearing element, and the second end of the light bar structure rotatably-coupled to the second bracket structure by a second bearing element; and a reflector structure, the reflector structure configured to re-direct a portion of light emitted from the light bar structure, the reflector structure further comprising:

a light scoop; and a spine structure, rigidly-coupled to a proximal side of the light scoop, the spine structure having a first end rotatably-coupled to the first bracket structure by a third bearing element, and a second end rotatably-coupled to the second bracket structure by a fourth bearing element, wherein an angle of rotation of the light bar structure is adjustable independently of an angle of rotation of the reflector structure.

2. The luminaire of claim 1, wherein the reflector structure comprises a uniform cross-sectional area along the longitudinal length of the housing structure.

3. The luminaire of claim 1, wherein the plurality of light sources are spaced apart along the longitudinal length of the housing structure in a linear array.

4. The luminaire of claim 1, wherein the plurality of light sources are spaced apart along the longitudinal length of the housing structure in two-dimensional array.

5. The luminaire of claim 1, wherein the first and second bearing elements are configured to:

resist rotational motion of the light bar structure due to a weight of the light bar structure exerted on the first and second bearing elements; and rotate to adjust the angle rotation of the light bar structure upon application of a manual rotational force to the light bar structure.

6. The luminaire of claim 1, wherein the third and fourth bearing elements are configured to:

resist rotational motion of the reflector structure due to a weight of the reflector structure exerted on the third and fourth bearing elements; and rotate to adjust the angle of rotation of the reflector structure upon application of a manual rotational force to the reflector structure.

7. The luminaire of claim 1, wherein the plurality of light sources are light-emitting diodes.

8. The luminaire of claim 1, wherein the first bracket structure further comprises:

a first lock mechanism configured to selectively prevent rotation of the light bar structure, and a second lock mechanism configured to selectively prevent rotational of the reflector structure.

9. The luminaire of claim 1, wherein the light scoop further comprises a substantially concave structure facing substantially towards the light bar structure.

10. The luminaire of claim 9, wherein the concave structure further comprises a reflective surface configured to reflect a portion of light emitted from the light bar structure.

11. The luminaire of claim 1, wherein a selected bracket, from the first and second brackets, further comprises a first scale and a second scale configured to give a visual indication of the angle of rotation of the light bar structure and the reflector structure, respectively.

12. A luminaire, comprising:

an elongated housing structure configured to be positioned within a recessed cove and having a first end spaced apart from a second end;

a first bracket coupled to the first end of the housing structure;

a second bracket coupled to the second end of the housing structure;

a light bar structure configured to emit visible light, the light bar structure having a first end spaced apart from a second end along a longitudinal length;

a first hinge structure, rigidly-coupled to the light bar structure along the longitudinal length, and configured to rotatably-couple the first end of the light bar structure to the first bracket and the second end of the light bar structure to the second bracket; and a reflector structure configured to re-direct a portion of light emitted from the light bar structure, having a longitudinal length substantially parallel to the longitudinal length of the light bar structure, the reflector structure further comprising:

a light scoop extending along the longitudinal length of the reflector structure; and a second hinge structure, rigidly-coupled to the light scoop, the second hinge structure configured to rotatably-couple a first end of the reflector structure to the first bracket and a second end of the reflector structure to the second bracket, wherein an angle of rotation of the light bar structure is adjustable independently of an angle of rotation of the reflector structure.

13. The luminaire of claim 12, wherein the light bar structure and the reflector structure are configured to rotate about the first hinge structure and the second hinge structure only upon application of a manual rotational force to the light bar structure and the reflector structure, respectively.

14. The luminaire of claim 12, further comprising:

a first tab structure coupled to the housing structure, wherein the first tab structure is configured to engage between a selected two of a first plurality of teeth, wherein the first plurality of teeth is configured in a circular arc around an outer hinge surface of the first hinge structure, wherein engagement between the first tab structure and the selected two of the first plurality of teeth is configured to resist rotation of the light bar structure under the weight of the light bar structure; and a second tab structure coupled to the housing structure, wherein the second tab structure is configured to engage between a selected two of a second plurality of teeth, wherein the second plurality of teeth is configured in a circular arc around an outer hinge surface of the second hinge structure, wherein engagement between the second tab structure and the selected two of the second plurality of teeth is configured to resist rotation of the reflector structure under the weight of the reflector structure.

15. The luminaire of claim 12, wherein light bar structure comprises a plurality of light-emitting diodes.

16. The luminaire of claim 12, wherein the light bar structure further comprises a heat sink.

17. The luminaire of claim 12, wherein the first and second hinge structures further comprise rotation stop elements, configured to limit rotational ranges of the light bar structure and the reflector structure, respectively.

18. The luminaire of claim 12, wherein the rotatable coupling of the light bar structure to the first and second brackets utilizes a first pair of bearing elements, and the rotatable coupling of the reflector structure to the first and second brackets utilizes a second pair of bearing elements.

* * * * *